US008790448B2

(12) United States Patent
Brück et al.

(10) Patent No.: US 8,790,448 B2
(45) Date of Patent: Jul. 29, 2014

(54) DEVICE FOR PRODUCING AN ELECTRICAL FIELD IN AN EXHAUST GAS SYSTEM

(71) Applicant: Emitec Gesellschaft fuer Emissionstechnologie mbH, Lohmar (DE)

(72) Inventors: Rolf Brück, Bergisch Gladbach (DE); Jan Hodgson, Troisdorf (DE); Christian Vorsmann, Köln (DE)

(73) Assignee: Emitec Gesellschaft fuer Emissionstechnologie mbH, Lohmar (DE)

( * ) Notice: Subject to any disclaimer, the term of this patent is extended or adjusted under 35 U.S.C. 154(b) by 0 days.

(21) Appl. No.: 13/803,569

(22) Filed: Mar. 14, 2013

(65) Prior Publication Data

US 2013/0291731 A1 Nov. 7, 2013

Related U.S. Application Data

(63) Continuation of application No. PCT/EP2011/065883, filed on Sep. 13, 2011.

(30) Foreign Application Priority Data

Sep. 15, 2010 (DE) ..... 10 2010 045 506

(51) Int. Cl.
*B03C 3/86* (2006.01)

(52) U.S. Cl.
USPC ..... 96/55; 96/68; 96/69; 96/97; 96/83

(58) Field of Classification Search
USPC ..... 96/55, 68, 69, 97; 60/275, 299, 311; 55/385.3, 523, 524, DIG. 30; 422/177, 422/178, 180
See application file for complete search history.

(56) References Cited

U.S. PATENT DOCUMENTS

| | | | | |
|---|---|---|---|---|
| 3,958,962 | A | 5/1976 | Hayashi | |
| 5,271,906 | A * | 12/1993 | Yuuki et al. | 422/177 |
| 5,465,573 | A * | 11/1995 | Abe et al. | 60/274 |
| 5,474,600 | A * | 12/1995 | Volodina et al. | 96/57 |
| 5,707,428 | A * | 1/1998 | Feldman et al. | 96/54 |
| 5,733,360 | A * | 3/1998 | Feldman et al. | 95/78 |
| 6,193,788 | B1 | 2/2001 | Nojima | |
| 6,712,884 | B2 | 3/2004 | Brück et al. | |
| 7,927,401 | B2 | 4/2011 | Brück | |
| 7,959,868 | B2 | 6/2011 | Sarai et al. | |
| 8,066,787 | B2 | 11/2011 | Althöfer | |
| 8,066,952 | B2 | 11/2011 | Hodgson et al. | |

(Continued)

FOREIGN PATENT DOCUMENTS

| | | | |
|---|---|---|---|
| DE | 2363149 | A1 | 7/1974 |
| DE | 20117659 | U1 | 1/2002 |

(Continued)

*Primary Examiner* — Duane Smith
*Assistant Examiner* — Sonji Turner
(74) *Attorney, Agent, or Firm* — Laurence A. Greenberg; Werner H. Stemer; Ralph E. Locher

(57) ABSTRACT

A device for producing an electrical field in an exhaust gas system includes an exhaust gas line in which at least one electrode is disposed. The at least one electrode is in contact with a power supply and is constructed to have at least one metal plate.

4 Claims, 2 Drawing Sheets

(56) References Cited

U.S. PATENT DOCUMENTS

| | | | | |
|---|---|---|---|---|
| 2004/0221572 | A1 | 11/2004 | Treiber | |
| 2007/0006556 | A1 | 1/2007 | Brück et al. | |
| 2007/0028603 | A1 | 2/2007 | Igarashi | |
| 2008/0155967 | A1 | 7/2008 | Maus et al. | |
| 2008/0170971 | A1* | 7/2008 | Bergeron et al. | 422/171 |
| 2009/0139190 | A1* | 6/2009 | Althofer | 55/385.3 |
| 2011/0111691 | A1 | 5/2011 | Kagawa et al. | |
| 2011/0139009 | A1 | 6/2011 | Nakahara et al. | |
| 2012/0186447 | A1 | 7/2012 | Hodgson et al. | |

FOREIGN PATENT DOCUMENTS

| | | | |
|---|---|---|---|
| DE | 102006001831 | A1 | 9/2007 |
| DE | 602004012896 | T2 | 4/2009 |
| EP | 0862949 | A2 | 9/1998 |
| EP | 1669563 | A1 | 6/2006 |
| EP | 2309198 | A1 | 4/2011 |
| JP | 2004353491 | A | 12/2004 |
| JP | 2007009839 | A | 1/2007 |
| JP | 2009074438 | A | 4/2009 |
| WO | 0180978 | A1 | 11/2001 |
| WO | 0200326 | A2 | 1/2002 |
| WO | 2005066469 | A1 | 7/2005 |
| WO | 2005099867 | A1 | 10/2005 |
| WO | 2006136431 | A1 | 12/2006 |
| WO | 2007140932 | A1 | 12/2007 |
| WO | 2009157170 | A1 | 12/2009 |
| WO | 2010021128 | A1 | 2/2010 |
| WO | 2011029728 | A1 | 3/2011 |

* cited by examiner

DEVICE FOR PRODUCING AN ELECTRICAL FIELD IN AN EXHAUST GAS SYSTEM

CROSS-REFERENCE TO RELATED APPLICATION

This application is a continuation, under 35 U.S.C. §120, of copending International Application No. PCT/EP2011/065883, filed Sep. 13, 2011, which designated the United States; this application also claims the priority, under 35 U.S.C. §119, of German Patent Application DE 10 2010 045 506.7, filed Sep. 15, 2010; the prior applications are herewith incorporated by reference in their entirety.

BACKGROUND OF THE INVENTION

Field of the Invention

The present invention relates to a device for producing an electrical field in an exhaust gas system, in particular in the exhaust gas system of a motor vehicle. In particular, the invention relates to a device for treating exhaust gas containing soot particles, in which the device can be used, in particular, with a so-called electrostatic filter or electric filter. To that extent, the invention is preferably applied in the treatment of exhaust gases of mobile internal combustion engines in the field of motor vehicles.

A multiplicity of different concepts for eliminating soot particles from exhaust gases in mobile internal combustion engines, have already been discussed. In addition to wall flow filters which are closed on alternate sides, open secondary flow filters, gravity precipitators, etc., systems have also already been proposed in which the particles in the exhaust gas are electrically charged and then precipitated by using electrostatic attraction forces. Those systems are known, in particular, by the designation "electrostatic filter" or "electric filter."

In the case of such electric filters, (a plurality of) discharge electrodes and collector electrodes positioned in the exhaust gas line are generally proposed. In that context, for example, a central discharge electrode which runs approximately centrally through the exhaust gas line and a surrounding lateral surface of the exhaust gas line as a collector electrode, are used to form a capacitor. With that configuration of the discharge electrode and of the collector electrode, an electrical field is formed transversely with respect to the direction of flow of the exhaust gas, wherein the discharge electrode can be operated, for example, with a high voltage which is in the region of approximately 15 kV. As a result, in particular corona discharges can form by which the particles flowing with the exhaust gas through the electrical field are charged in a unipolar fashion. Due to that charge, the particles migrate to the collector electrode as a result of the electrostatic Coulomb forces.

In addition to systems in which the exhaust gas line is embodied as a collector electrode, systems are also known in which the collector electrode is embodied, for example, as a wire mesh. In that context, the accumulation of particles on the wire mesh serves the purpose, under certain circumstances, of combining the particles with further particles in order to thereby achieve an agglomeration. The exhaust gas which flows through the mesh then carries the relatively large particle agglomerates along with it and feeds them to classic filter systems.

Even if the systems described above have heretofore proven suitable, at least in trials, for the treatment of soot particles, the implementation of that concept for series operation in motor vehicles still constitutes a large technical challenge. That applies, in particular, with respect to the greatly fluctuating soot load in the exhaust gas, which is very high at times. Likewise, the desired retrofitability of such a system for exhaust gas systems which exist at present still constitutes a large problem. In particular, quantities of exhaust gas which generally increase suddenly occur in the exhaust gas system of motor vehicles, and do not occur, for example, in stationary internal combustion engines which are used to generate power. Furthermore, the exhaust gas systems are subject to mechanical loading, for example due to unevenness of the ground. In addition, it is necessary to bear in mind the fact that in view of the increased power and/or effectiveness of such exhaust gas systems it is also necessary to regenerate the filter systems (periodically and/or continuously) in order to eliminate soot particles, in which the regeneration involves the conversion of the soot into gaseous components.

When filter systems are regenerated, it is also known not only to perform intermittent regeneration by brief heating, that is to say burning the soot (catalytically motivated, oxidative conversion), but also to convert the soot by using nitrogen dioxide ($NO_2$). The advantage of the continuous regeneration with nitrogen dioxide is that the soot can then already be converted at significantly lower temperatures (in particular less than 250° C.). For that reason, continuous regeneration is preferred in many application cases. However, that leads to the problem that it is necessary to ensure that the nitrogen dioxide in the exhaust gas comes into contact with the accumulated soot particles to a sufficient extent.

In that context, technical difficulties arise in the implementation of continuous operation of such exhaust gas systems in motor vehicles, wherein the different loading of the internal combustion engines gives rise to different exhaust gas flows, compositions of exhaust gas and/or temperatures.

Furthermore, it is to be borne in mind that when such components are made available for such a soot precipitation system, as far as possible simple components are to be used, in particular also components which can be manufactured cost-effectively as part of a series production. Furthermore, particularly with respect to the structure of the electrodes, it is necessary to bear in mind that under certain circumstances they have to be positioned so as to be aligned in the exhaust gas line, in particular in such a way that an undesirably high ram pressure or undesired eddying of the exhaust gas does not occur in the region of the electrode.

SUMMARY OF THE INVENTION

It is accordingly an object of the invention to provide a device for producing an electrical field in an exhaust gas system, which overcomes the hereinafore-mentioned disadvantages and at least partially solves the highlighted problems of the heretofore-known devices of this general type. In particular, a device for producing an electrical field in an exhaust gas system is to be proposed which can be made available with simple measures and known technologies, even as part of a series production. In addition, the device is to be easy to integrate into an exhaust gas line, in particular in such a way that selective orientation of the electrodes towards the desired electrical field or the assigned particle trap is made possible.

With the foregoing and other objects in view there is provided, in accordance with the invention, a device for producing an electrical field in an exhaust gas system, comprising an exhaust gas line in which at least one electrode, which is placed in contact with a power supply, is disposed. In this context, the at least one electrode is formed with at least one metal plate, the at least one electrode extends in the flow direction of the exhaust gas, and all of the electrodes have a plurality of projections in the flow direction of the exhaust gas.

This device is, in particular, a pole of an electrostatic filter. It is preferred in this case that the electrical field be a (if appropriate pulsed) direct voltage field. In this context, in particular, voltages in the range from 10 kV to 30 kV (kilovolts) can be generated. The exhaust gas system is, in particular, that of a mobile internal combustion engine, in particular that of a diesel engine of a motor vehicle. The region of the exhaust gas line which is embodied with a corresponding electrical field can, if appropriate be electrically insulated and this can be implemented in the axial direction of the exhaust gas line, as well as radially towards the outside. The at least one electrode is positioned in this case in the interior of the exhaust gas line, that is to say in the space through which the exhaust gas flows. The at least one electrode is placed in electrical contact with a power supply in this case, for example by using corresponding electrical conductors, plugs, soldered or brazed connections, etc. In particular, an electrically encapsulated feedthrough of the power supply through the exhaust gas line is also preferred in this case.

In order to provide improved alignment of the electrode in the interior of the exhaust gas line and simplified manufacture and formation of contact with the electrode, it is then proposed that the electrode be formed with at least one metal plate. A "metal plate" is understood to be, in particular, a (planar) strip made of flat metal material or sheet metal. The metallic plate may be embodied in this case in such a way that it is substantially smooth or flat, but it is also possible for the metal plate to be structured, that is to say, for example, for it to have a corrugation. Series production is already very far advanced with respect to the production of metallic honeycomb bodies as catalyst carriers in exhaust gas systems. Therefore, a precise embodiment of similarly configured metal plates has already been implemented in this case. This production knowledge can now be used to also implement such metal plates as electrodes and to use them to produce a corresponding electrical field. For this purpose, the metal plate has to be constructed with corresponding contact conductors, electrical conductors, solder or brazing material points and the like, so that a predefined current path can be formed by using the metal plate itself and, if appropriate, also using insulating coatings or inlays for the metal plate. Of course, corresponding electrically conductive materials are considered in this context.

A planar side of the metal plate is preferably disposed parallel to the flow direction of the exhaust gas. As a result, the metal plate offers the smallest possible flow resistance to the flowing exhaust gas.

The metal plate is made, in particular, from a material with a low ohmic resistance, which cumulatively or alternatively has only a limited oxidation capability. The metal plate is to be preferably made from a homogeneous material, with the result that a uniform field is formed with a good ionization capability at the projections. The metal plate preferably has a thickness of less than 0.1 mm, particularly preferably of less than 0.065 mm, quite particularly preferably of less than 0.035 mm. In this context, it is considered particularly preferable that the at least one electrode extends in the flow direction of the exhaust gas. That is also to say in other words that the metal plate is disposed with respect to the flow direction of the exhaust gas in such a way that it offers the smallest possible flow resistance. In this respect, the planar side of the metal plate is disposed, in particular, parallel to the flow direction of the exhaust gas. As a result of this configuration and embodiment of the electrode, strong turbulences of the exhaust gas when contact occurs with the electrode and/or an increased pressure loss when the exhaust gas passes, are avoided.

Furthermore, the at least one electrode has a plurality of projections in the flow direction of the exhaust gas. A corresponding projection can be generated, for example, by virtue of the fact that the material of the metal plates is removed or punched out near to an end-side edge. The remaining projections, which are directed, in particular, in the direction of the electrical field, are suitable for forming local centers for the electrical field. In certain circumstances, it may also be appropriate that only these projections are placed in contact with corresponding electrical conductors, while remaining parts of the metal plate are electrically insulated. It is therefore possible for the flow to be guided selectively with respect to these projections. In particular, in this context, it is considered advantageous that the metal plate or the projections are disposed or oriented with respect to the exhaust gas line in such a way that they result in a uniform electrical field toward a collector electrode, in particular a particle trap disposed downstream. It is quite particularly preferred in this case that just one (single) metal plate is provided which, however, has a plurality of projections which each form electrode tips. In particular it is preferred that the at least one projection has a length of 15 mm [millimeters] to 20 mm [millimeters] in the flow direction, with the result that oscillation of the projections during operation is avoided.

In accordance with another feature of the invention, at least three projections are formed, in each case, at a distance from at least two adjacent projections, and the distances are substantially equal. This means, in particular, that the distances differ at most by 10%. The distances are preferably at least 10 mm, particularly preferably at least 30 mm, quite particularly preferably at least 50 mm. In this way, a very uniform electrical field is formed which has local field strength maxima distributed uniformly over a cross section in the region of the projections. For this purpose, the projections have to be disposed on the metal plate at a distance from one another which corresponds with the winding. The relatively large distances also prevent, in particular, an (undesired) electrical field from forming between the projections.

The at least one projection preferably forms an electrode which comes to a point, wherein the point of the projection has an angle of at least 30°, preferably of at most 20°, particularly preferably of at most 10°. It is also proposed that the at least one tip of the projection be oriented transversely with respect to the flow direction, wherein points of various projections can be oriented in different directions.

In accordance with a further feature of the invention, the at least one electrode is integrated into a honeycomb body. It is therefore known, for example, to make available metallic honeycomb bodies in which at least partially structured layers made of metal foils are stacked, wrapped and/or wound one on top of the other in order to form substantially parallel channels. Even if these metal foils of the honeycomb body can, if appropriate, be embodied with a relatively thin material thickness, the honeycomb structure should be considered as a whole as being relatively rigid so that the electrode can be securely fixed to the metal plate with these metal foils or the honeycomb body. As a result, it is therefore possible for the honeycomb body to constitute a type of support structure for the electrode or the metal plate. It is clear in this case that the electrode must, if appropriate, be electrically insulated with respect to the honeycomb body. If in this context, for example, electrically insulating coatings are provided, they can also serve as a basis for electrical conductors to the electrode, which conductors are applied easily to this electrical insulating coating.

In accordance with a particularly preferred concomitant field of application of the invention, a particle trap is disposed downstream of the at least one electrode in the flow direction of the exhaust gas. It is quite particularly preferred in this case that the particle trap which is disposed (directly) downstream in this case serves as a type of collector electrode. As a result, the soot particles which flow through the region between the at least one electrode and the particle trap are charged in the electrical field positioned there and are finally deflected toward the filter material of the particle trap. In this context it is, of course, also simultaneously possible for an agglomeration to take place. The particle trap is, in particular, a so-called open secondary flow filter in which no completely closed flow channels are present. The particle trap is instead formed with a metallic nonwoven and metallic corrugations, in the openings of which guiding structures, etc. are provided. The guiding structures in this case form flow constrictions in the flow passages with the result that the residence time or probability of impact for soot particles in the interior of the particle trap is increased. In this context, reference is made to the known patent publications by the Applicant of the instant application, which can be used for more detailed characterization of the particle trap and/or the regeneration thereof. In particular, incorporation herein by reference is made to the entire extent of the description of the following documents:

International Publication No. WO 01/80978, corresponding to U.S. Pat. No. 8,066,952;

International Publication No. WO 02/00326, corresponding to U.S. Pat. No. 6,712,884;

International Publication No. WO 2005/099867, corresponding to U.S. Pat. No. 7,959,868;

International Publication No. WO 2005/066469, corresponding to U.S. Patent Application Publication No. 2007/006556;

International Publication No. WO 2006/136431, corresponding to U.S. Patent Application Publication No. 2008/155967, and International Publication No. WO 2007/140932, corresponding to U.S. Pat. No. 8,066,787.

Such a particle trap is preferably regenerated continuously in this case on the basis of the CRT method. For this purpose, for example, an oxidation catalytic converter in which nitrogen monoxide is (also) oxidized to form nitrogen dioxide, which then reacts with the soot in the particle trap, can be connected upstream of the device. In addition, it is also possible for such an oxidatively acting coating to be implemented in the particle trap itself, either in a zone thereof or else in all of the regions of the particle trap.

Other features which are considered as characteristic for the invention are set forth in the appended claims, noting that the features which are specified individually in the claims can be combined with one another in any technically appropriate fashion and disclose further refinements of the invention.

Although the invention is illustrated and described herein as embodied in a device for producing an electrical field in an exhaust gas system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
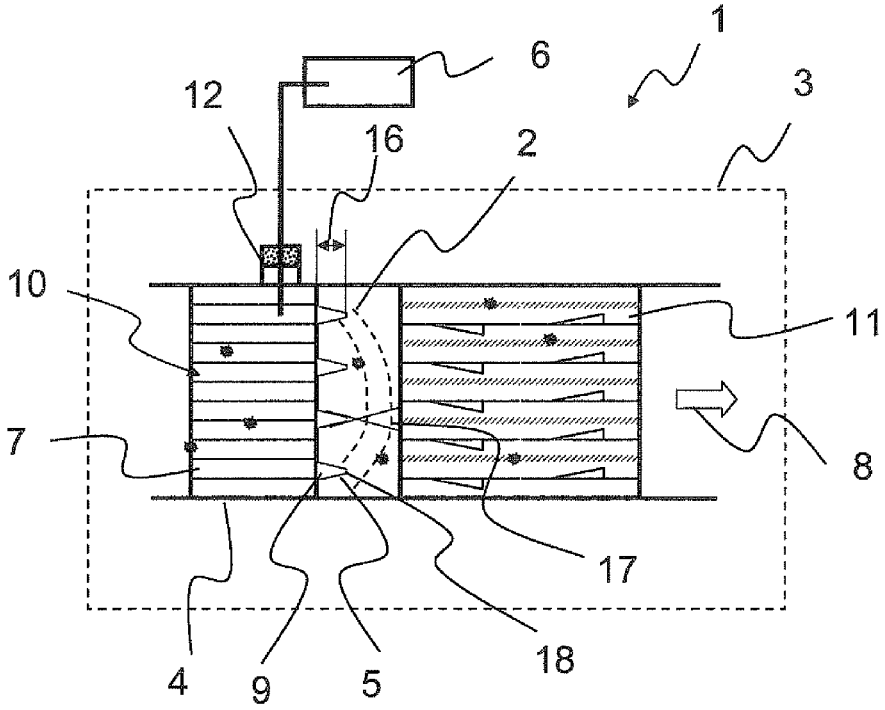
FIG. 1 is a diagrammatic, longitudinal-sectional view of a first embodiment variant of the device according to the invention.

Referring now to the figures of the drawings in detail and first, particularly, to FIG. 1 thereof, there is seen a first embodiment variant of a device 1 according to the invention for generating an electrical field 2 in an exhaust gas system 3. In this case, the device 1 also includes a region of an exhaust gas line 4 in which at least one electrode 5 is disposed. In the embodiment variant shown therein, a plurality of electrodes 5 are integrated into an (individual) honeycomb body 10. In order to form a corresponding electrical contact, a power supply 6 is provided which is led through an electrical contact 12 in such a way that it is electrically insulated with respect to the exhaust gas line 4. The electrodes 5 are formed in this case with a metal plate 7 (which is separate if appropriate) that extends substantially parallel in a flow direction 8 of the exhaust gas and has a plurality of projections 9 at the ends. In this context, the desired electrical field 2, in which soot particles can agglomerate or be charged, is formed between the electrodes 5 and a particle trap 11 which follows in the flow direction 8. The electrically charged particles then impact on the particle trap 11, where they are preferably embedded in or on filter material and are converted within the scope of regeneration into gaseous components. FIG. 1 also shows that the projections 9 have a length 16 leading to points 18 which form an angle 17.

Figure 2:
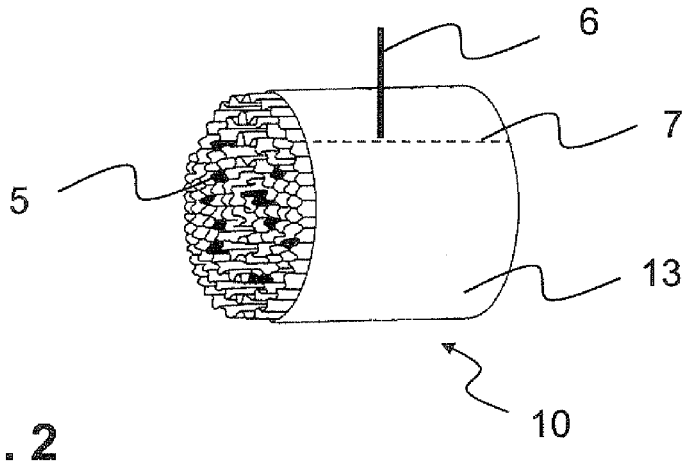
FIG. 2 is a perspective view of a further embodiment variant of the device relating to an electrode formed with a honeycomb structure.

FIG. 2 illustrates an embodiment variant of the device 1, wherein the electrodes 5 are again integrated into a honeycomb body 10. A cylindrical housing 13, in which a multiplicity of at least partially structured (electrically inactive) metal foils (illustrated in white) and (at least partially electrically active) metal plates (indicated in black) are disposed is shown therein in a perspective illustration. In this context, channels through which a flow can occur and which run substantially parallel to one another are formed between the structures of the metal foils or metal plates. An electrical contact with the desired metal plate or sheet metal element 7 can be implemented by using a corresponding power supply 6 leading through the housing 13, with the result that a supply of power to the electrodes 5 is ensured. In this case, the electrodes 5 extend in a projecting fashion beyond an end side where preferably a uniform distribution over a cross section of the honeycomb body 10 is preferred.

Figure 3:
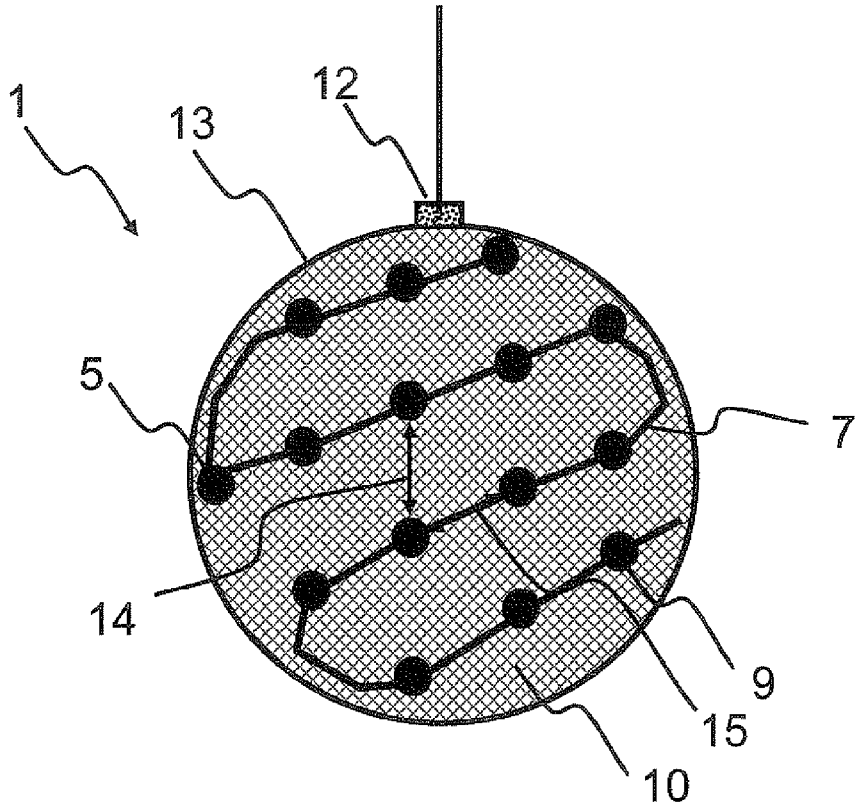
FIG. 3 is an end-elevational view of an embodiment variant of the device, as seen in the flow direction.

FIG. 3 is a diagrammatic end view as seen in or counter to the flow direction of the exhaust gas, onto an embodiment of the device 1 according to the invention. A honeycomb body 10 is disposed in a housing 13. The honeycomb body 10 contains at least one metal plate 7 which forms projections 9 that serve as electrodes 5. A voltage can be applied to the electrodes through an electrical contact 12. Each projection 9 is at least a first distance 14 and a second distance 15 from adjacent electrodes 5. The first distance 14 and the second distance 15 are substantially equal, so that the projections 9 are distributed uniformly over an end face of the honeycomb body 10.

The problems described at the beginning with respect to the prior art have therefore been at least partially solved. In particular, a device for producing an electrical field in an exhaust gas system has been specified which can be made available with simple measures and known technologies, even within the scope of series production. In addition, the device can easily be integrated into an exhaust gas line, in particular in such a way that selective alignment of the electrodes with respect to the desired electrical field or the assigned particle trap is made possible.

The invention claimed is:

1. A device for producing an electrical field in an exhaust gas system, the device comprising:

an exhaust gas line defining an exhaust gas flow direction;

a honeycomb body;

at least one electrode integrated in said honeycomb body and extending in said exhaust gas flow direction in said exhaust gas line, said at least one electrode being formed with at least one metal plate positioned within said honeycomb body and extending parallel to said exhaust gas flow direction, and each said at least one electrode having a plurality of projections extending in said exhaust gas flow direction; and a power supply in contact with said at least one electrode.

2. The device according to claim 1, wherein said at least one electrode includes at most three electrodes.

3. The device according to claim 1, wherein said plurality of projections includes at least three projections each disposed at an equal distance from at least two other adjacent projections.

4. The device according to claim 1, which further comprises a particle trap disposed downstream of said at least one electrode in said exhaust gas flow direction.

* * * * *